United States Patent [19]

Smith

[11] 4,192,546

[45] Mar. 11, 1980

[54] WHEELCHAIR ABDUCTION PILLOW

[76] Inventor: Margaret B. Smith, 1215 Kent Rd., Raleigh, N.C. 27606

[21] Appl. No.: 931,300

[22] Filed: Aug. 7, 1978

[51] Int. Cl.² ..... A62B 35/00; A47C 31/00

[52] U.S. Cl. ..... 297/466; 297/DIG. 4; 297/427

[58] Field of Search ..... 297/384, 390, DIG. 4, 297/427; 128/80 R, 80 A; 5/81 R, 92, 66

[56] References Cited

U.S. PATENT DOCUMENTS

| | | | |
|---|---|---|---|
| 391,637 | 10/1888 | Moritz | 297/385 |
| 2,652,883 | 9/1953 | Holtzendorff | 297/390 X |
| 2,949,152 | 8/1960 | Hipps et al. | 297/390 X |
| 3,307,872 | 3/1967 | Murcott | 297/385 |
| 3,339,544 | 9/1967 | Kravitz | 128/80 R |
| 3,397,913 | 8/1968 | Fein | 297/385 |
| 3,423,773 | 1/1969 | Yamate | 297/390 X |
| 3,839,755 | 10/1974 | Iannucci | 5/92 |

FOREIGN PATENT DOCUMENTS

| | | | |
|---|---|---|---|
| 2318056 | 2/1977 | France | 297/390 |
| 1301595 | 12/1972 | United Kingdom | 297/384 |

*Primary Examiner*—James T. McCall
*Attorney, Agent, or Firm*—Mills and Coats

[57] ABSTRACT

The present invention relates to an abduction pillow that is particularly adapted to be utilized in conjunction with a wheelchair. The abduction pillow comprises a generally flat backboard that is adapted to be positioned between the footrest and seat area of the wheelchair and includes a divider cushion secured to the front of said backboard that extends upwardly between a sitting patient's legs so as to prevent the knees of the patient from moving inwardly across the divider cushion and for preventing the legs of the patient from being drawn generally underneath the seat area of the wheelchair.

10 Claims, 3 Drawing Figures

WHEELCHAIR ABDUCTION PILLOW

The present invention relates to orthopedic devices, and more particularly to an abduction pillow assembly adapted to be utilized in conjunction with a wheelchair for maintaining a sitting patient's legs in an appropriate position.

BACKGROUND OF THE INVENTION

Abduction pillows and cushions have been used in the past as an orthopedic device to maintain a patient's legs in an appropriate position with respect to the patient's body. For example, see the disclosures found in U.S. Pat. Nos. 3,423,773; 3,834,376; and 3,339,544.

Orthopedic abduction devices are particularly useful to patients that have undergone hip surgery. It is essential that limits be placed on the movement of the patient's legs, after hip surgery, to assure that the head of the thigh bone is maintained within its socket. This is because the legs tend to be drawn with respect to the patient's body so as to pull and place stress on the hip joint, sometimes resulting in dislocation of the head of the thigh bone from its socket. When this occurs, post hip surgery is required.

One particular area that has presented special problems for patients after hip surgery is the particular problem presented by a patient who has had hip surgery and is placed in a wheelchair. It is the tendency for the patient's legs, while sitting in a wheelchair, to be drawn underneath the seat of the wheelchair and/or for the patient's knees to be drawn inwardly towards each other. Either situation is undesirable because in such cases a pulling action occurs about the hip joint and it is not uncommon for such to lead to hip dislocation which requires post-op hip surgery.

Thus, there is a real need for an orthopedic device that is adapted to be utilized in conjunction with a wheelchair, in which it is particularly designed to maintain the patient's legs in proper position and orientation about the lower front area of the wheelchair.

SUMMARY OF INVENTION

The present invention presents a wheelchair abduction pillow that is adapted to be positioned about a wheelchair between the footrest and the upper edge of the wheelchair seat. The abduction pillow basically comprises a padded backboard that extends across the lower front area of the wheelchair and includes a divider cushion extending generally vertically across the front face of the backboard so as to define two leg receiving areas on each side of the pillow. The presence of the backboard prevents the legs from being drawn underneath the seat of the wheelchair, while the presence of the divider pillow or cushion prevents the knees and other portions of the legs from moving inwardly past the general central area of the backboard, thereby maintaining the legs of a patient who has experienced hip surgery in a proper position and orientation.

It is, therefore, an object of the present invention to provide an abduction pillow for a wheelchair for maintaining a patient's legs (after hip surgery) in a proper and safe position, and which is particularly adapted to prevent the patient's legs from being drawn underneath the seat area of the wheelchair or from the the patient's knees moving inwardly so as to place an undue stress or pulling action on the patient's hip.

It is a further object of the present invention to provide an abduction pillow for a wheelchair that generally maintains a patient's legs in proper position about the front area of the wheelchair in order that the legs do not drift or pull or move in directions that have the potential to cause hip dislocation.

Another object of the present invention is to provide an abduction pillow for a wheelchair that is relatively simple and inexpensive, and which can be easily and conveniently adapted and attached to a wheelchair.

It is also a further object of the present invention to provide an abduction pillow for a wheelchair that is particularly adapted to confine the legs of a patient who has experienced hip surgery to an area about the lower front part of the wheelchair and to prevent the legs from being drawn underneath the chair or the knees to move inwardly; and wherein such abduction pillow generally prevents contractures, increases circulation, prevents edema and generally prevents hip dislocation after hip surgery that would ordinarily require new post-op hip surgery.

A further object of the present invention to provide a wheelchair abduction pillow of the character described above, wherein the central divider pillow or cushion is detachable.

Another object of the present invention to provide an abduction pillow for a wheelchair, of the character described above, wherein the same is provided with a divider cushion and a cushion extension that is adapted to project between the legs generally about the seat area so as to extend between the inner thigh areas of the patient while sitting in the wheelchair.

Also it is an object of the present invention to provide in one embodiment of the abduction pillow design, an abduction pillow that includes a footboard and strap means disposed about each sides of the divider cushion for confining the legs about the abduction pillow.

Other objects and advantages of the present invention will become apparent from a study of the following description and the accompanying drawings which are merely illustrative of the present invention.

THE WHEELCHAIR ABDUCTION PILLOW

Figure 1:
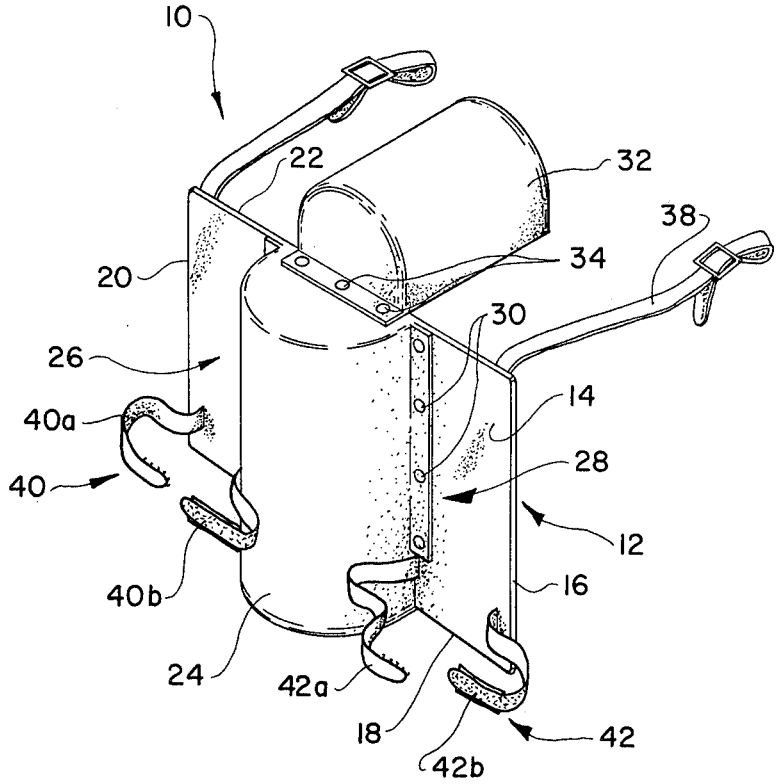
FIG. 1 is a perspective view of the orthopedic abduction pillow of the present invention.

With further reference to the drawings, a wheelchair abduction pillow, indicated generally by the numeral 10, is shown therein and includes a generally planar backboard or back leg retaining means indicated generally by the numeral 12. Backboard 12 of the design shown in the drawings is generally rectangular and includes an inner rigid panel constructed of plywood, plastic, or the like, covered with a padded soft surface.

Figure 2:
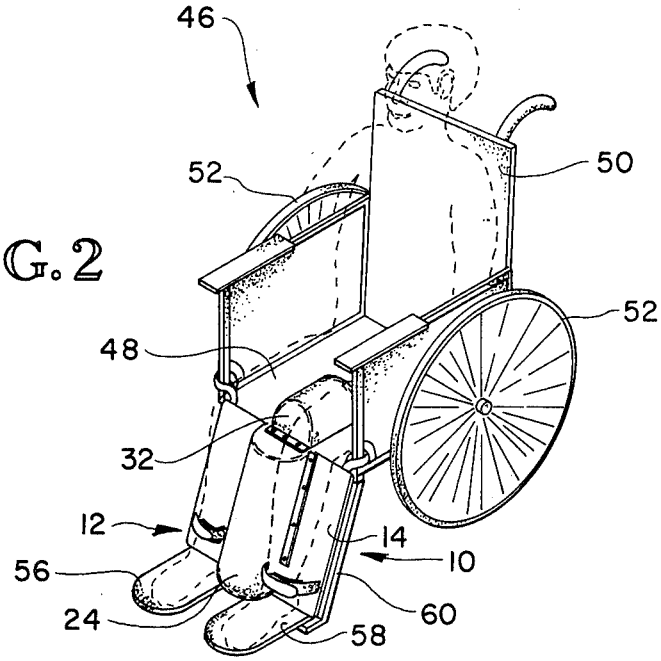
FIG. 2 is a perspective view of the abduction pillow of the present invention secured about a wheelchair illustrating its utility.
Figure 3:
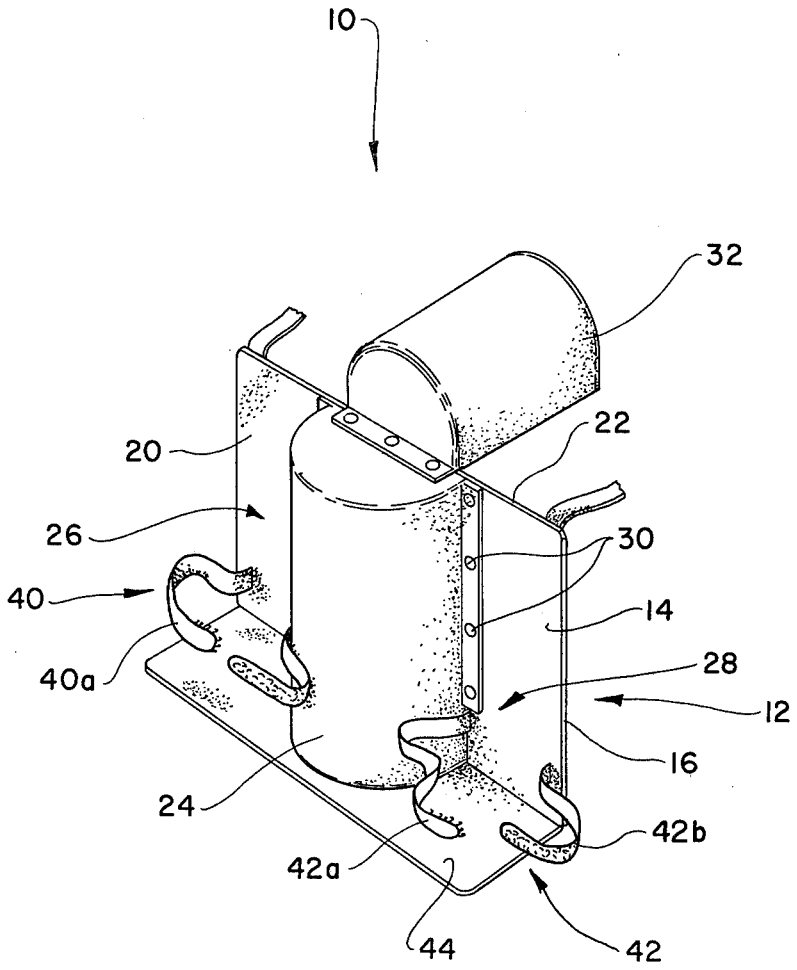
FIG. 3 is a perspective view of an alternate design for the abduction pillow of the present invention.

The front of backboard 12 is referred to as a front face 14 and since the embodiment illustrated in FIGS. 1 through 3 is generally rectangular, the backboard includes side edges 16, 18, 20 and 22.

Secured about front face 14 of backboard 12 is a divider cushion 24 that extends substantially the entire length from the lower edge 18 to the top edge 22 generally midway between edges 16 and 20 so as to define two leg retaining areas 26 and 28 on each side thereof. The divider cushion 24 may be detachably secured to backboard 12 by a series of snap assemblies 30.

Secured about the top of backboard 12 adjacent the top portion of the divider cushion 24 is a divider cushion extension 32 that is designed to project between the upper thigh areas of the patient's legs when the abduction pillow 10 is utilized in conjunction with a wheelchair, as is shown in FIG. 2 and as will be subsequently discussed herein. Divider cushion 24 and the divider cushion extension 32 are generally constructed of soft foam-like resilient material with a vinyl, leather or other suitable type covering provided thereover. In the case of the divider cushion extension 32, the same may be detachably secured by snaps 34, as illustrated in FIGS. 1 and 2, in order that the same may be easily and conveniently removed from backboard 12.

The abduction pillow 10 is particularly designed to be utilized in conjunction with a wheelchair and is adapted to extend between the footrest and the front edge of the wheelchair seat. In order to securely hold the abduction pillow 10 about the wheelchair, there is provided a pair of attaching straps 36 and 38 that are adapted to be secured about the wheelchair in order to support the abduction pillow 10 thereabout.

It may be preferred to provide ankle or leg straps, indicated generally by the numerals 40 and 42, about the lower portions of each of the leg receiving areas 26 and 28. In the embodiment illustrated, the leg or ankle strap assemblies 40 and 42 includes cooperating straps **40*a*, 40*b*, 42*a* and 42*b***, that are preferably of the velcro attaching type and includes an inner sheepskin lining in order that a soft gentle type material may be exposed to the legs and particularly about the ankle area in order to prevent an abrasive irritating effect about the patient's legs or ankles.

With particular reference to FIG. 3, a second embodiment of the abduction pillow 10 of the present invention is shown therein and the same is substantially like the embodiment illustrated in FIG. 1 except that along the lower edge thereof there is provided a footboard 44 for supporting the patient's feet. Preferably, the abduction pillow 10 would be positioned with respect to the wheelchair such that the footboard 44 extends transversely across the lower front of the wheelchair just above the footrest of the wheelchair.

Turning to the use of the wheelchair abduction pillow 10, reference is made to FIG. 4 showing a wheelchair, indicated generally by the numeral 46, having the abduction pillow 10 attached thereon. Viewing the basic structure of the wheelchair 46, it is seen that the same includes a seat 48, a back 50, a pair of support wheels 52, and a pair of footrests 56 and 58 disposed about the lower front area of the wheelchair and supported by a pair of front footrest support legs 60 that extend from the front of the wheelchair just below the seat 48 to the footrests 56 and 58 for supporting the same.

In use, the abduction pillow 10 is positioned across the front of the footrest support legs 60 depending downwardly from the seat 48 of the wheelchair. As shown in FIG. 2, the attaching straps 36 and 38 are attached to the wheelchair in any chosen manner such that the abduction pillow or orthopedic device 10 is securely held about the lower front of the wheelchair. In the case of the embodiment illustrated in FIG. 1, the lower edge 18 of the backboard 12 would terminate just short of the footrests 56 and 58 or rest thereon, and the backboard 12 would extend upwardly to where the upper edge 22 would terminate just short or approximately equal to the level of the seat 48. Consequently, it is appreciated that the defined leg areas 26 and 28 that are defined by the divider cushion 24 extend downwardly about each side of the backboard 12 in alignment with seat 48.

In FIG. 2, a patient is shown sitting in the wheelchair 46 in dotted lines, with his respective legs extending on each side of the divider cushion 24. It is, therefore, appreciated that the backboard 12 on each side of the divider cushion 24 prevents the patient's legs from being drawn past the plane of the backboard 12 and underneath the chair seat 48. In addition, the presence of the divider cushion 24 and its extension 32 that is pushed between the upper inner thigh areas of the patient, as indicated in FIG. 2, prevents the individual's legs from crossing over either divider cushion 24 or the extension cushion 32. Moreover, the tendency of the patient's knees to move inwardly is prevented and in fact stopped by the presence of the divider cushion 24.

It is important to realize that with the wheelchair abduction pillow 10 of the present invention that contractures are prevented, circulation is increased, edema is prevented, and generally the orthopedic device of the present invention may prevent the requirement of new post-op hip surgery. Expanding on these briefly, when the legs of a patient are allowed to be drawn underneath the wheelchair seat the muscle in the thigh and the calf of the leg contract and becomes smaller. The result is that it then becomes very difficult to extend the leg through normal expected extensions due to such contractures. In addition, when the legs are drawn underneath the wheelchair seat, pressure from the seat and particularly the front terminal edge thereof tends to engage the back of the thigh and exert a force thereagainst that is sufficient to cut off circulation and particularly cuts off circulation to the patient's feet. When circulation is cut off, then a patient is likely to experience edema and consequently this results in swelling.

Finally, where the legs of a patient who has just experienced hip surgery are free to be drawn under the seat of the wheelchair and/or the knees to move inwardly, a substantial stress or pulling action is placed on the hip joint where surgery was performed, and it is not uncommon for this stress, force or pulling action to result in a hip dislocation, and in such cases, new post-op hip surgery is required. Because such operations are serious, expensive, painful, they should if at all possible be avoided, and with the provision of the abduction pillow 10 of the present invention, such new post-op hip surgery that is required due to the lack of control of the patient's legs while in a wheelchair is prevented.

From the foregoing specification, it is apparent that the abduction pillow 10 of the present invention presents a new and useful orthopedic device that operates in conjunction with a wheelchair, and which is relatively simple and inexpensive.

The terms "upper", "lower", "forward", "rearward", etc., have been used herein merely for the convenience of the foregoing specification and in the appended claims to describe the wheelchair abduction pillow and its parts as oriented in the drawings. It is to be understood, of course, that these terms are in no way limiting to the invention since the wheelchair abduction pillow may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A wheelchair abduction pillow adapted to be utilized in conjunction with a wheelchair of the type having a seat, a footrest, and support members depending downwardly for supporting said footrest, where said wheelchair abduction pillow maintains a sitting patient's legs in a proper position and generally prohibits the patient's legs from being drawn inwardly and underneath the seat area of the wheelchair; said abduction pillow comprising: a back leg retaining means adapted to be positioned between the seat area and footrest of said wheelchair so as to generally close the area about the lower front portion of the wheelchair below said seat area for preventing a patient's legs from being drawn into the area below said seat area; divider cushion means secured to said back leg retaining means and extending generally vertically thereacross to define a leg retaining area about each side thereof, said divider cushion means projecting forwardly from said leg retaining means for effectively dividing the patient's legs and preventing the patient's knees from crossing over the area occupied by said cushion means.

2. The wheelchair abduction pillow of claim 1 wherein said back leg retaining means includes a generally flat panel having top, bottom, and side edges; and wherein said divider cushion means includes a first cushion portion that extends substantially from the bottom to the top of said back leg retaining means, and a second cushion portion extending freely from the top portion of said back leg retaining means and projecting therefrom for being inserted between the patient's thighs above the level of the seat area of said wheelchair.

3. The wheelchair abduction pillow of claim 2 wherein said back leg retaining means includes a generally rigid inner panel with a padded outer surface so as to generally define a backboard.

4. The wheelchair abduction pillow of claim 3 wherein said backboard is generally rectangularly shaped; and wherein there is additionally provided a footboard secured about the lower portion of said backboard and extending generally forwardly therefrom and disposed generally perpendicular thereto.

5. The wheelchair abduction pillow of claim 4 further including a pair of ankle strap means secured to said backboard about each side of said divider cushion for strapping and securing the legs of the patient in a secure position adjusting said backboard.

6. The wheelchair abduction pillow of claim 5 wherein there is provided detachable securing means for detachably securing said divider cushion to said backboard.

7. The wheelchair abduction pillow of claim 6 wherein said strap means disposed about each side of said divider cushion includes first and second attachable straps, and wherein there is provided an inner sheepskin lining about each strap and wherein there is also provided velcro attaching means for attaching the respective straps together.

8. The wheelchair abduction pillow of claim 1 further including means secured to said back leg retaining means and extending therefrom for securing said abduction pillow to said wheelchair.

9. In a wheelchair of the type having a seat, a back, footrest means, and support members depending downwardly for supporting said footrest means, the improvement comprising: a wheelchair abduction pillow assembly for maintaining a sitting patient's legs in a proper position and generally prohibiting the patient's legs from being drawn inwardly and underneath the seat area of the wheelchair, said wheelchair abduction pillow including a back leg retaining means adapted to be positioned between the seat area and said footrest means of said wheelchair so as to generally close the area about the lower front portion of the wheelchair below said seat area for preventing a patient's legs from being drawn into the area below said seat area; divider cushion means secured to said back leg retaining means and extending generally vertically thereacross to define a leg retaining area about each side thereof, said divider cushion means projecting forwardly from said leg retaining means for effectively dividing the patient's legs and preventing the patient's knees from crossing over the area occupied by said cushion means; and means secured to said leg retaining means for firmly securing the same to said wheelchair between the seat and footrest means thereof.

10. The improved wheelchair and abduction pillow therefor of claim 1 wherein said back leg retaining means includes a generally flat panel having top, bottom, and side edges; and wherein said divider cushion means includes a first cushion portion that extends substantially from the bottom to the top of said back leg retaining means, and a second cushion portion extending freely from the top portion of said back leg retaining means and projecting therefrom for being inserted between the patient's thighs above the level of the seat area of said wheelchair.

* * * * *